United States Patent [19]

Nuttall

[11] Patent Number: 4,762,289

[45] Date of Patent: Aug. 9, 1988

[54] CONTINUOUS SUPPLY OF ELONGATE MATERIAL

[75] Inventor: Alan T. Nuttall, Stubbins, United Kingdom

[73] Assignee: Harland Machine Systems Limited, Salford, Manchester, England

[21] Appl. No.: 16,760

[22] Filed: Feb. 20, 1987

[30] Foreign Application Priority Data

Feb. 28, 1986 [GB] United Kingdom ..... 8504996
Dec. 3, 1986 [GB] United Kingdom ..... 8628948

[51] Int. Cl.[4] ..... B65H 19/14; B65H 19/24

[52] U.S. Cl. ..... 242/58.1; 242/55; 242/55.21

[58] Field of Search ..... 242/55, 55.18, 55.19 R, 242/55.21, 58.1

[56] References Cited

U.S. PATENT DOCUMENTS 3,273,814 9/1966 Prusak et al. ..... 242/55
3,782,662 1/1974 Miller ..... 242/55.19 R X
4,012,005 3/1977 Hattersley ..... 242/55
4,163,527 8/1979 Hood et al. ..... 242/55
4,441,661 4/1984 Steinmair ..... 242/55
4,505,438 3/1985 Sendzimir et al. ..... 242/55

*Primary Examiner*—Stuart S. Levy
*Assistant Examiner*—Thomas R. Hannon
*Attorney, Agent, or Firm*—Pearson & Pearson

[57] ABSTRACT

A method of, and apparatus for, the continuous supply of elongate material, for example label-carrying webs, are provided. The method comprises feeding the material from a first reel thereof of predetermined initial inner and outer diameters to an expanded reel having an inner diameter greater than that initial outer diameter, replacing a spent first reel with a second reel of the same initial dimensions within the expanded reel and joining the trailing end of the expanded reel to the leading end of the second reel. The apparatus for performing this method comprises rotatably drivable inner and outer coaxial, coplanar discs within a stationary cylindrical wall. The first reel is placed on the inner disc and is driven therewith. The material is fed from the first reel to an expanded reel formed on the inside of the wall and then out of an aperture in that wall, the expanded reel providing an accumulation of material so that splicing of the ends can be performed without stopping the feed of material from the apparatus.

19 Claims, 4 Drawing Sheets

CONTINUOUS SUPPLY OF ELONGATE MATERIAL

Figure 1:
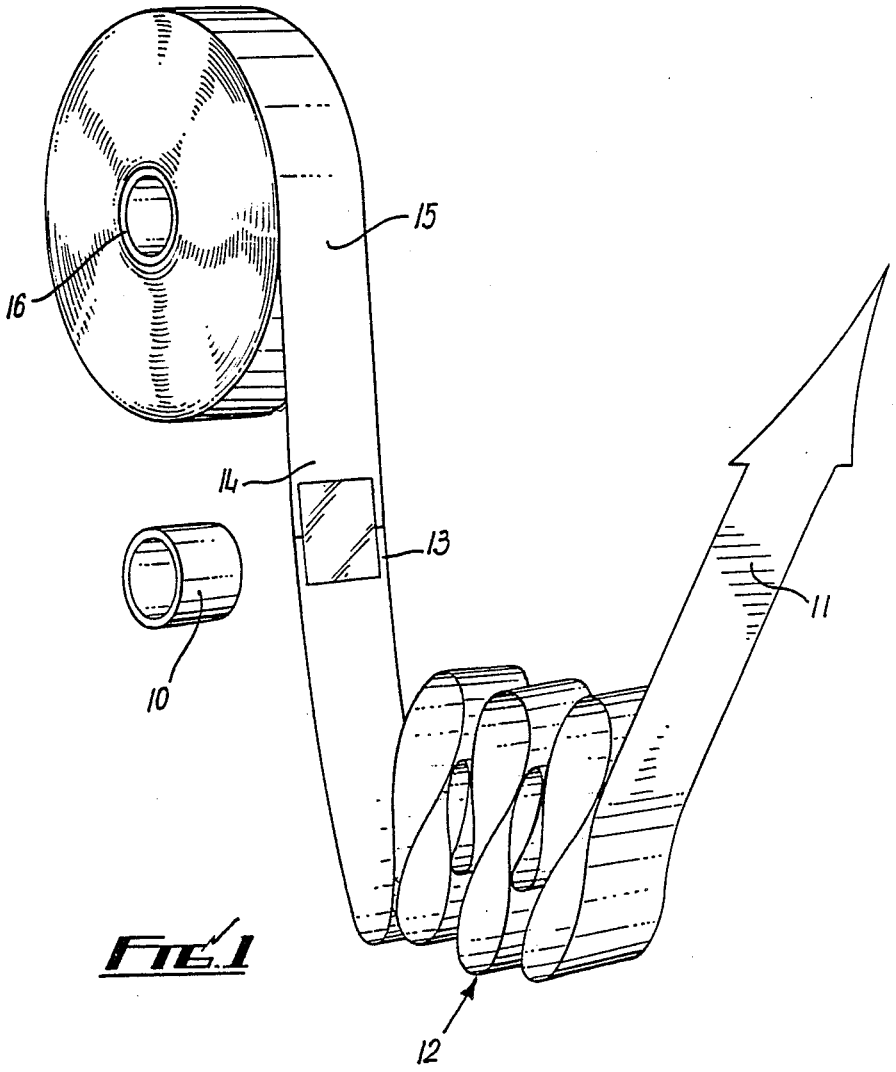

This invention relates to a method of providing a continuous supply of elongate material and is more particularly concerned with a method of and apparatus for the splicing of label-carrying webs in automatic labelling machines.

A well-known kind of automatic labelling machine has a labelling head to which an elongate web carrying pressure sensitive adhesive backed label is fed from a supply reel. At the labelling head the labels are stripped one at a time from the web, by passing this around a sharp edge, and are applied to articles to be labelled e.g. as such articles are advanced past the head on a conveyor. The support web passes to a take-up reel after the labels have been stripped off at the labelling head.

The advent of high speed pressure sensitive labelling systems has meant running time between reel changes has diminished. Therefore it has become desirable to be capable of performing reel changes without stopping the labelling machine or its supply of labels.

Currently there are two ways of allowing a reel fed labelling machine to run continuously.

In a first system, known as dual label feed, the supply of labels is provided by two reel fed label units alternately, i.e. when label unit 1 is dispensing labels, label unit 2 is loaded with a new reel. When the reel in unit 1 is exhausted unit 2 automatically switches onto supply, thus leaving unit 1 free to be re-charged with a new reel of labels.

In a second system, when the supply reel is spent, the trailing end of the web is spliced to the leading end of a web of a fresh reel. This splicing has to be effected accurately to ensure trouble-free passage of the label-carrying web through the labelling head and to maintain the required spacing of the labels. Customarily this has been achieved by stopping the trailing end of the spent reel, carefully butting this end against a pre-cut leading end of the fresh reel, and fixing the two ends together with adhesive tape. This procedure can however be difficult to perform satisfactorily without stopping the labelling machine especially in the case of modern high speed labelling systems. To achieve this a supply from a diminished reel of labels is dumped into an accumulator in such a way as to allow the tail end of the supply to be exposed, thus enabling the leading edge of a new reel of labels to be spliced to it, either manually or automatically. The operation of splicing is undertaken with the machine running, the supply of labels being taken from the acccumulated buffer stock of labels thus enabling continuous running of the machine.

In order to overcome the aforementioned difficulties there is described in our co-pending Patent Application No. 8502225 a method of joining first and second lengths of elongate material in which an end portion of the first length is disposed in superimposed relationship relative to an end portion of the second length, the free end of the end portion of the first length is fixed to the adjacent portion of the second length, and the end portion of the second length is cut away level with the free end of the first length.

With this arrangement, it is not necessary to ensure that both ends are correctly pre-cut and carefully butted against each other. It is only necessary to ensure proper superimposition whereupon correct butting can then be automatically attained when the said end portion is cut away. Accordingly, accurate splicing is achieved in a particularly simple, convenient and quick manner.

An object of the present invention is to provide an improved method applicable to the splicing of label-carrying webs with which such splicing can be effected quickly and accurately.

The invention provides a method of continuously supplying elongate material comprising providing a supply of said material from a first reel thereof of predetermined initial inner and outer diameters, subsequently feeding said material into an expanded reel having an inner diameter greater than said predetermined initial outer diameter, providing a second reel of said material having said predetermined initial inner and outer diameters within said expanded reel and joining a trailing end of said expanded reel to a leading end of said second reel.

The joining of the trailing end of the expanded reel to the leading end.of the second reel may be by splicing manually or automatically.

The method may also include withdrawing said material from said expanded reel at a rate which is less than that at which said material is fed to said expanded reel from said first reel. The method may also include sensing the quantity of said material in said expanded reel and stopping the feeding of said material thereto when said quantity exceeds a predetermined value and restarting said feeding thereto when said quantity falls below a predetermined value.

The invention also provides apparatus for continuously supplying elongate material comprising drive means operable to locate and drive in rotation a first reel of said material of predetermined initial inner and outer diameters, a stationary collecting surface disposed concentrically with said drive means on which an expanded reel of larger inner diameter than said predetermined initial outer diameter may be formed of material withdrawn from said first reel, and withdrawing means operable to withdraw said material from said expanded reel. The apparatus may comprise joining means operable to join a trailing end of said expanded reel to a leading end of a second reel when located and driven by said drive means, which joining means may comprise manual or automatic splicing means.

Said withdrawing means may be operable to withdraw said material from said expanded reel at a rate less than that at which said material is fed thereto from said first reel. The apparatus may also comprise sensing means operable to sense the quantity of material in said expanded reel, to stop said drive means when said quantity exceeds a predetermined value and to restart said drive means when said quantity falls below a predetermined value.

Said drive means may comprise inner and outer concentric and coplanar discs and may comprise a central mandrel adapted to receive said first or said second reels thereon. Said mandrel may be rotatable with said inner disc. Said drive means may also comprise driving means operable to drive said discs in rotation.

The invention will now be further described with reference to the accompanying drawings in which:

FIG. 1 is a diagrammatic illustration of the accumulate and splice principle.

Figure 2A:
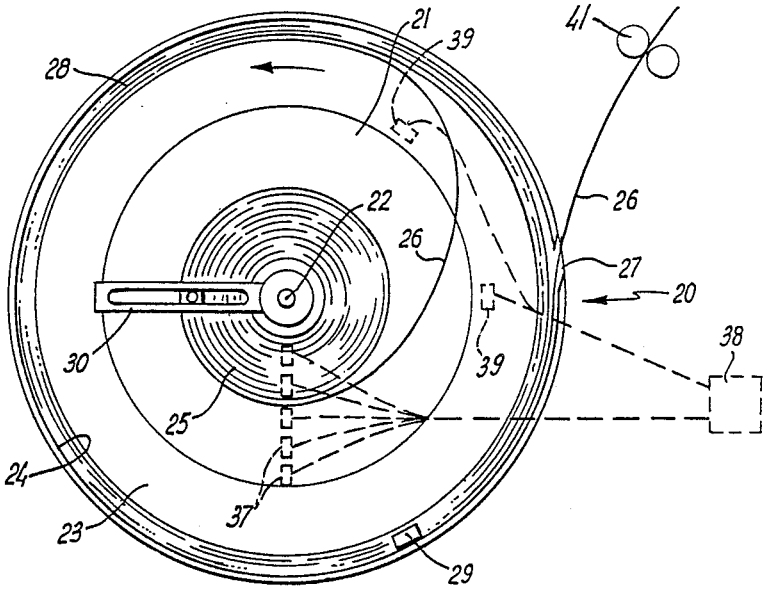
Figure 2B:
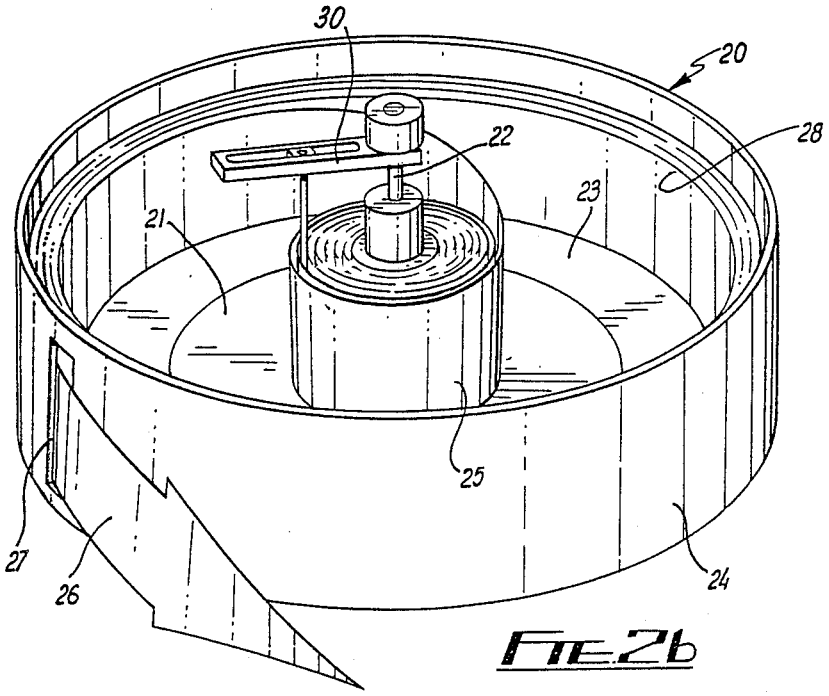
Figure 3:
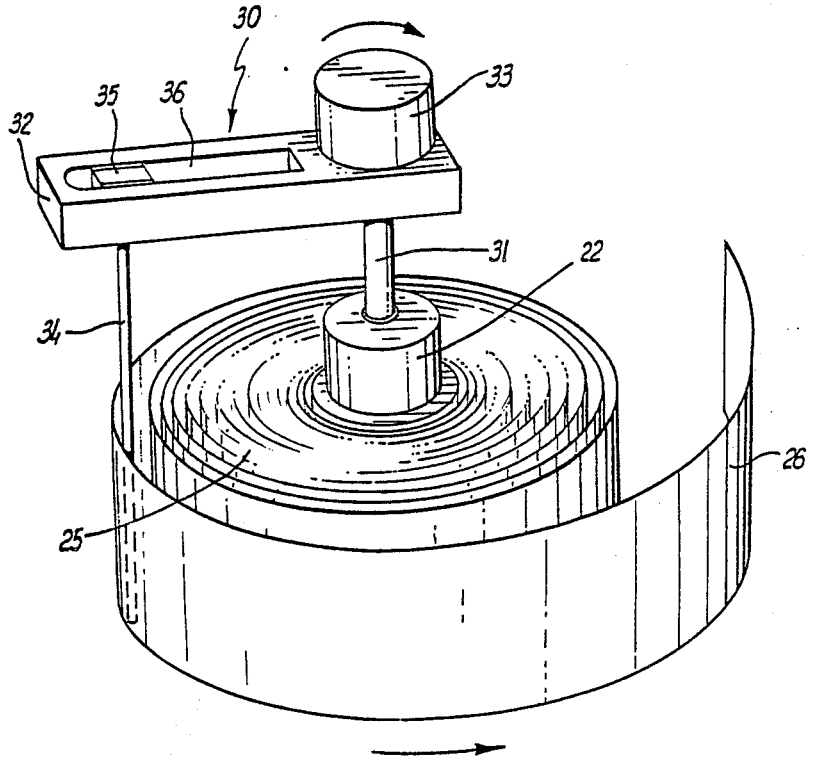
Figure 4:
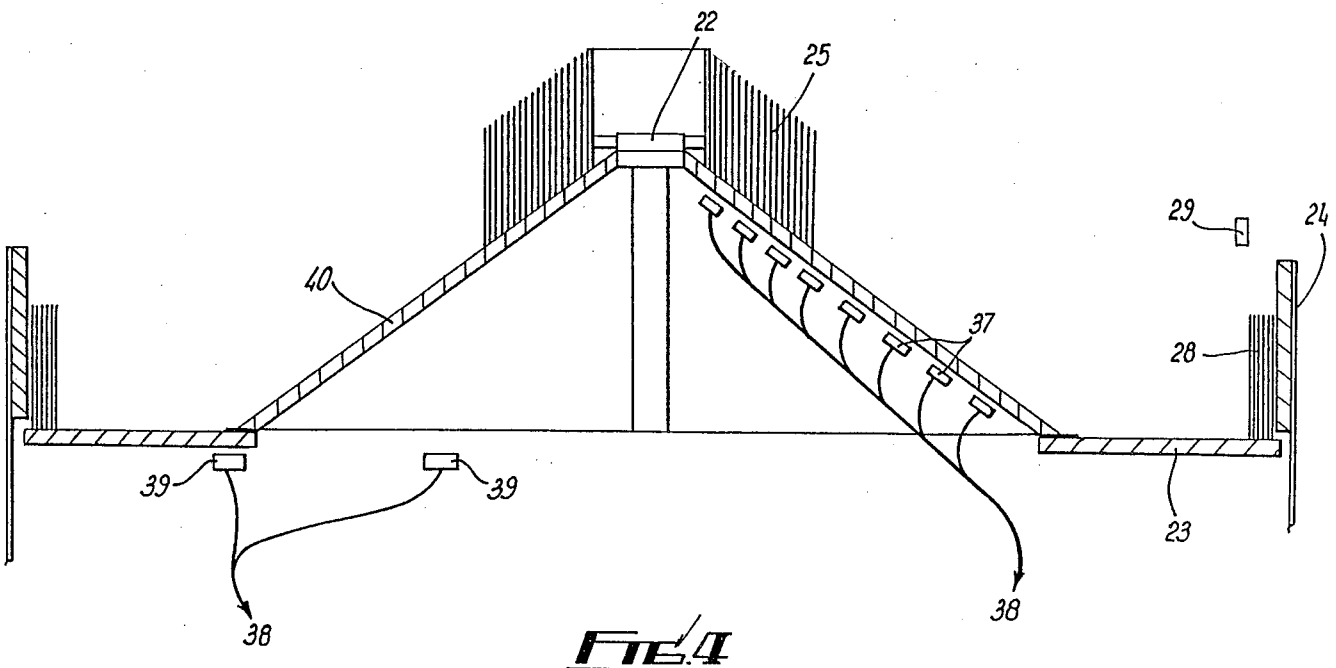

FIGS. 2*a* and 2*b* are plan and perspective views respectively of one embodiment of apparatus in accordance with the invention, FIG. 3 is a perspective view of part of the apparatus of FIGS. 2*a* and 2*b* with an additional unwinding assist mechanism shown in greater detail, and FIG. 4 is a sectional elevation of a second embodiment.

Referring now to FIG. 1 there is shown a first reel 10 from which all of the elongate material 11 has just been withdrawn to be fed to a labelling machine (not shown). Between the first reel 10 and the labelling machine the material 11 is accumulated as shown at 12. This accumulation 12 allows for the splicing of the trailing end 13 of the material 11 to the leading end 14 of material 15 provided on a second reel 16. The material 11 may be withdrawn from the accumulation 12 whilst the splicing of ends 13,14 is effected and then the material 15 can be fed to the accumulation 12 at a slightly faster rate than the material is withdrawn therefrom so that the accumulation 12 is restored by the time that a subsequent splicing of the trailing end of the material 15 from second reel 16 to the leading end of another reel is required.

Referring now to FIGS. 2*a* and 2*b* there is shown an apparatus 20 for continuously supplying elongate material which embodies the above described accumulate and splice principle. In this case the apparatus 20 comprises an inner disc 21 mounted on or integral with a central mandrel 22. Concentrically disposed with respect to the inner disc 21 and mandrel 22 are an outer disc 23 and a stationary cylindrical collecting surface 24. A reel 25 of material 26 of predetermined initial inner and outer diameters is placed on the mandrel 22, so as to be rotatably driven by the inner disc 21 on which it rests, and an aperture 27 is provided in the surface 24 through which the material 26 may be withdrawn to a labelling machine (not shown) or the like. Driving means (not shown), for example a variable speed motor, is operable to drive in rotation the inner and outer discs 21,23 usually at the same speed and usually in the same direction, although the disc 21 may be driven at a different speed and/or in the reverse direction from those of the disc 23 if required, so that material 26 is withdrawn from the rotating reel 25 mounted on the fixed or rotating mandrel 22, and passes through the aperture 27 to the labelling or other machine. However before passing through the aperture 27, the material 26 is formed into an accumulation in the form of an expanded reel 28 retained by the stationary collecting surface 24. To ensure that there is a sufficient quantity of material 26 in the expanded reel 28 a sensor 29 is provided. The sensor 29 is operable to sense the quantity of material 26 in the expanded reel 28, i.e. by sensing the radial thickness of the reel 28, and to stop or restart the rotation of the inner disc 21 when the quantity exceeds or falls below respectively a predetermined quantity. The outer disc 23 rotates continuously throughout this operation. The speed of the driving means is regulated so that the material 26 is unwound from the reel 25 at a greater rate than it is withdrawn bv withdrawing means 41 so that the material 26 accumulates in the expanded reel 28.

To maintain a reasonably constant unwind rate of the material 26 from the reel 25 the variable speed motor may be operated on a multi-speed system, e.g. by means of gearing in the drive between the motor and the disc 21. For this purpose sensors 37 are located beneath the disc 21 to sense the diameter of the reel 25 thereon and by means of a logic device 38 to adjust the motor speed or gearing to suit the rate of decrease of that diameter. In addition, protection against the material 26 being unwound in an irregular manner may be provided by means of sensors 39 located beneath the outer disc 23 and operable to sense the direction of rotation of the material 26 as it travels from the reel 25 to the expanded reel 28. Two or more sensors 39 may be provided, for example at 60° angular separation to send signals to the logic device 38 as the material 26 passes thereover, the logic device 38 being operable to distinguish between correct and incorrect operation of the apparatus 20 and to alter the speed of rotation of the disc 21 accordingly. The sensor 29 operates to maintain the quantity of material 26 in the expanded reel 28 substantially equal to the predetermined quantity, successively stopping and restarting the rotation of inner disc 21 and reel 25 as the material 26 accumulates to the predetermined quantity in expanded reel 28, and then the reel 28 diminishes to a lesser quantity as the feed to the labelling machine is maintained whilst the feed from reel 25 is stopped.

When the reel 25 diminishes to a predetermined low level the sensor 29 receives a signal to maintain rotation of the inner disc 21 until all of the material 26 has been transferred to the expanded reel 28, when the disc 21 is then stopped. The trailing end of the material 26 will be exposed on the inner surface of the expanded reel 28, which is of greater diameter than the predetermined initial diameter of the supply reel 25. A new supply reel having the same predetermined initial inner and outer diameters, may then be placed on the mandrel 22 and the leading end of the material thereon joined to the trailing end of the material 26 in the expanded reel 28. Because the outer disc 23 is still rotating the expanded reel 28 is maintained in its location against the collecting surface 24 whilst diminishing in size since the feed to the labelling machine is also maintained during this operation. A butt splice may be used, the ends of the material from the two reels having been prepared previously either manually or automatically.

When the splice has been effected the inner disc 21 will remain stationary until the quantity of material 26 in the expanded reel 28 falls below the predetermined value, when the complete cycle of operations is repeated.

The apparatus 20 may also comprise an unwind assist mechanism 30 as shown in greater detail in FIG. 3. The purpose of the mechanism 30 is to assist the withdrawal or unwinding of material 26 from the reel 25, particularly in the case of reels of adhesive labels from which adhesive may seep or "bleed", or in the case of a build up of static electricity within the reel, either of which can resist such unwinding. The mechanism 30 comprises a central shaft 31 which is rotated in the opposite direction to that of inner and outer discs 21,23, and at a slightly higher speed. To this shaft 31 a cross-arm 32 is connected by means of a friction clutch 33. Suspended from the cross-arm 32 by means of a spring-loaded slide 35 is a finger 34. The slide 35 is received in a slideway 36 in the cross-arm 32 and is resiliently biassed inwardly so that the finger 34 is always pressed against the reel 25 irrespective of the latter's diameter. As the inner disc 21 rotates and the material 26 unwinds from the reel 25 rotating therewith the finger 34 travels around the surface of the reel 25 to release the material 26 therefrom. Since the finger 34 is rotating in the opposite direction to that of the reel 25 it tends to wind itself into the reel coils until the resistance caused by the inter-coil pressure causes the friction clutch 33 to slip and "forward" rotation of the finger 34 ceases. After sufficient coils have been unwound from the reel 25 to reduce the inter-coil pressure "forward" rotation of the finger 34 recommences.

As an alternative to the unwind assist mechanism 30, or in addition thereto if required, the apparatus 20 may be modified as shown in FIG. 4. In this embodiment the flat inner disc 20 of the previously described arrangement is replaced by a conical plate 40 which is attached to or integral with the central mandrel 22. The weight of the outer layers of material 26 on the reel 25 assists the downward slipping of successive turns of material 26 relative to each other so that the reel 25 tends to adopt the conical shape of the plate 40. This also assists in the unwinding of the outermost turn of material 25. In consequence, depending upon the nature of the material 25 the basic apparatus 20 may be used without any unwind assist mechanism, or with either or both of the unwind assist mechanisms 30 or 40.

The apparatus of the invention may be an integral part of a labelling head or may be an individual module which can stand alongside and supply any machine requiring continuous supplies of elongate material.

The apparatus of the invention may be incorporated in a labelling machine or it may be a separate stand-alone device.

With regard to the variable speed motor this may be used in a multi speed system without any intermediate gearing between the motor and the disc 21.

What is claimed is

1. A method of continuously supplying elongate material comprising providing on central mandrel a supply of said material from a first reel thereof having predetermined initial inner and outer diameters, rotating an inner disc to subsequently feed said material into an expanded reel formed on a rotatable outer disc concentric and coplanar with said inner disc, said expanded reel having an inner diameter greater than said predetermined initial outer diameter, providing a second reel of said material having a leading end and having said predetermined initial inner and outer diameters, locating said second reel on said central mandrel within said expanded reel when said first reel has expired and said expanded reel has a trailing end, and joining said trailing end of said expanded reel to said leading end of said second reel.

2. A method according to claim 1 comprising rotating said inner disc at a first rate to feed said material from said first reel to said expanded reel, and withdrawing said material from said expanded reel at a second rate which is less than said first rate.

3. A method according to claim 1 comprising sensing the quantity of material in said expanded reel and stopping the rotation of said inner disc and the feeding of said material to said expanded reel when said quantity exceeds a predetermined value and restarting said feeding thereto when said quantity falls below a predetermined value.

4. A method according to claim 1 comprising sensing the diameter of said first reel and adjusting the rate of rotation of said inner disc and said first reel in accordance with the rate of decrease of said diameter.

5. A method according to claim 1 comprising sensing the direction of rotation of said material as it travels from said first reel to said expanded reel and adjusting the speed of rotation of said inner disc and said first reel in accordance therewith.

6. A method according to claim 1 comprising releasing material from said first reel prior to feeding said material to said expanded reel.

7. A method according to claim 6 wherein said first reel has successive turns of said material thereon and said releasing method comprises rotating said inner disc and said first reel in a first direction, locating a finger between said successive turns and rotating said finger in the opposite direction to said first direction.

8. A method according to claim 7 comprising resiliently biassing said finger radially inwardly of said first reel.

9. Apparatus for continuously supplying elondate material comprising drive means operable to locate and drive in rotation a first reel of said material having predetermined initial inner and outer diameters, a stationary collecting surface disposed concentrically with said drive means against which an expanded reel of larger internal diameter than said predetermined outer diameter may be formed of material withdrawn from said first reel, and withdrawing means operable to withdraw said material from said expanded reel, wherein said drive means comprises a central mandrel adapted to receive a first reel thereon, and inner and outer concentric and coplanar discs.

10. Apparatus according to claim 9 comprising means operable to feed said material to said expanded reel from said first reel at a first rate, wherein said withdrawing means is operable to withdraw said material from said expanded reel at a rate less than said first rate.

11. Apparatus according to claim 9, comprising sensing means operable to sense the quantity of material in said expanded reel, to stop said drive means when said quantity exceeds a predetermined value and to restart said drive means when said quantity falls below a predetermined value.

12. Apparatus according to claim 9, wherein said inner disc is conical.

13. Apparatus according to claim 9, wherein said mandrel is rotatable with said inner disc.

14. Apparatus according to claim 9, wherein said collecting surface has an aperture therein through which said material may be withdrawn from said expanded reel.

15. Apparatus according to claim 9, comprising sensing means operable to sense the diameter of said first reel and to adjust the speed of rotation of said driving means in accordance with the rate of decrease of said reel diameter.

16. Apparatus according to claim 9, comprising sensing means operable to sense the direction of rotation of said material as it travels from said first reel to said expanded reel and to adjust the speed of rotation of said driving means.

17. Apparatus according to claim 9, comprising unwind assist means operable to release said material from said first reel prior to feeding said material to said expanded reel.

18. Apparatus according to claim 1, comprising means operable to rotate said drive means in a first direction, wherein said unwind assist means comprises a finger and means operable to drive said finger in rotation in the opposite direction to said first direction.

19. Apparatus according to claim 18, comprising resilient means operable to bias said finger radially inwardly of said apparatus, and said finger drive means includes a friction clutch.

* * * * *